US005351993A

United States Patent [19]

Wright et al.

[11] Patent Number: 5,351,993

[45] Date of Patent: Oct. 4, 1994

[54] HUNTING LICENSE

[75] Inventors: Kenneth D. Wright, Grand Rapids, Mich.; Kent P. Blackwell, Neenah, Wis.

[73] Assignee: Bissell Graphics Corporation, Grand Rapids, Mich.

[21] Appl. No.: 925,076

[22] Filed: Aug. 5, 1992

[51] Int. Cl.[5] ..... B42D 15/00

[52] U.S. Cl. ..... 283/62; 283/79; 283/80; 283/105

[58] Field of Search ..... 283/62, 78, 79, 80, 283/81, 105

[56] References Cited

U.S. PATENT DOCUMENTS

| | | | |
|---|---|---|---|
| 1,052,865 | 2/1913 | Ward | 253/79 X |
| 1,075,505 | 10/1913 | Singleton | 283/80 X |
| 1,593,192 | 7/1926 | Respess et al. | 283/79 X |
| 1,760,417 | 5/1930 | Lake | 283/79 X |
| 2,365,716 | 12/1944 | Metzner | 283/62 |
| 3,697,101 | 10/1972 | Loos et al. | 283/62 |
| 4,615,929 | 10/1986 | Alexander, Jr. | 283/62 X |

FOREIGN PATENT DOCUMENTS

| | | | |
|---|---|---|---|
| 3538987 | 5/1987 | Fed. Rep. of Germany | 283/80 |

*Primary Examiner*—Paul A. Bell

*Attorney, Agent, or Firm*—Warner, Norcross & Judd

[57] ABSTRACT

Hunting license forms are disclosed which are suitable for issuance at a computerized point-of-sale terminal and printer. The hunting license forms are provided in a continuous web of forms with pin feed tractor holes, each form having a license tag portion and a record portion. The marginal edge of the license tag portion has a reinforcing strip overlyingly adhered thereto such that the pin feed holes may also be used for the passage of a cord for attaching the tag to an animal carcass. The forms are marked with a design and have regions of contrasting color which make the forms difficult to counterfeit. The forms are preprinted basic, nonvariable information such that one form may be used to provide several types of licenses.

12 Claims, 2 Drawing Sheets

HUNTING LICENSE

BACKGROUND OF THE INVENTION

1. Field of the Invention

The present invention relates to a hunting license and, more particularly, to a printable hunting license forms suitable for use at a computerized point-of-sale terminal. As used herein and in the appended claims, the term "hunting" refers to the capture and/or killing of any game animal and is intended to include fishing.

2. Description of the Related Art

Hunting licenses are issued by governmental authorities for various purposes such as to protect and control the game animal population, as a source of revenue, and ensure that hunters are qualified to use weapons in a safe manner. Such hunting licenses are printed on forms which provide at least a license document which the hunter or fisherman carries as evidence that he is authorized to be hunting or fishing, and which is fixed to an animal carcass as evidence that the animal was killed by a licensed person. Also, the form from which the license document is produced also includes a record portion to be retained by the agent who issued the license.

A page of hunting license forms according to the prior art is shown in FIG. 1. In plan, the page 10 is rectangular, and is formed with holes 12 for placing the page in a binder. The right portion of the page comprises several back tags/kill tags 14 temporarily joined together by perforated lines 16 at the adjacent upper and lower edges of the tags. The left portion 18 of the page comprises several record portions 20 corresponding to the tags 14.

The left portion 18 also includes a flap 22 which is a lamination of adhesive backed paper on a release liner. The flap 22 is die cut at 24 to form removable adhesive license stamps 26. Beneath the flap 22, there is a second flap of carbon paper 28 which transfers information written on the stamps 26 to the underlying record portion 20. A perforated line 30 is provided for separating the flaps 22, 28 from the record portions 20. Perforated line 32 is provided for separating the tags 14 from the left portion 18.

The tags 14 are formed from a tough sheet material, such as the synthetic fibrous material available under the trademark TYVEK, and the left portion 18 is formed from paper. The tags 14 and left portion 18 are adhered together at an overlap 34. Each tag 14 is formed with a hole 26 adjacent its right edge and fitted with a metal grommet 38. The hole and grommet provide a reinforced opening through which may pass a cord for securing the tag to an animal carcass without tearing the tag.

The page 10 of hunting license forms is used as follows: The hunter purchases a passbook of adhesive stamps from the governmental authority. The hunter then purchases the desired number of licenses from an issuing agent. The agent writes the issuance date on the license stamps 26 corresponding to the purchased licenses. The issuance date is also transferred to the record portions 20 below the stamps 26. The license stamps 26 are peeled off and adhered in the hunter's passbook. A first passbook stamp for each purchased license is removed from the hunter's passbook and adhered to the area 40 of the tag 14. A second passbook stamp for each purchased license is removed from the hunter's passbook and adhered to the area 42 of the record portion. The tags 14 for each purchased license are separated from the page and given to the hunter. When the page is fully sold, the agent removes the flaps 22 and 28. The left portion 18 is kept by the agent and later sent to the governmental authority.

While hunting, the hunter must keep a tag 14 visible by pinning the tag to his back or placing the tag in a windowed pocket on the back of his jacket. When the hunter kills an animal, the tag is affixed to the carcass by a cord passing through the hole 36 and grommet 38.

The page 10 is preprinted with all the textual material shown in FIG. 1, including a unique license number at three places 43, identification of the type of license 44, the year 45 for which the license is effective, and the amount of the licensee fee.

It is evident from the above description that the hunting license form according to the prior art necessitates an elaborate and expensively produced multipart form and separate passbook with adhesive stamps. The form is an assembly of TYVEK sheet material, paper, die cut adhesive stamps with release backing, carbon paper, and metal grommets. Nearly all of the essential information is preprinted on the form, making the form usable for only one type of game license.

Furthermore, the hunting license form of the prior art requires an equally elaborate procedure for issuance. The hunter must first obtain a passbook containing adhesive passbook stamps. Two passbook stamps must be transferred from the passbook to the license tag and record portion of the form. Another stamp must be peeled from a flap on the form and transferred to the passbook. The agent must remove and discard two flaps. The record portion must be retained by the agent then forwarded to the governmental authority. This complicated procedure tends to increase the likelihood that errors will be made.

Computerized terminals have become widely available and used for the issuance of official documents such as lottery tickets and driver's licenses. Such "point-of-sales" terminals have greatly facilitated and simplified the issuance of such documents. The terminal may be used to record transaction data at the point of sale and to transmit the data to a central location such as a governmental office.

Heretofore, point-of-sale terminals have not been used in the issuance of hunting licenses due to the unsuitability of the hunting license forms for use in computerized printers. The flaps on the form would tend to jam the printhead. The metal grommets on the license tags would interfere with the pin feed tractor mechanism used in many printers.

SUMMARY OF THE INVENTION

The present invention provides a simplified, economically constructed and secure and versatile hunting license form suitable for use with computerized printers at point-of-sale terminals and which provides a hunting license tag which may be securely affixed to an animal carcass.

According to a preferred embodiment of the invention, a plurality of hunting license forms are formed of flexible sheet material and are joined together at adjacent top and bottom edges by perforated lines, thus providing a continuous web of forms. Each form includes a license back tag/kill tag, hereinafter referred to as a "license tag portion," and a record portion. Each license tag portion is joined to its corresponding record portion at adjacent side edges by a perforated line.

The marginal portion along the free side edge of each license tag portion opposite the record portion is overlaid by an adhered reinforcing strip of a tough, thin and flexible material. A suitable material is a polyester film sold under the trademark MYLAR. Pin feed tractor sprocket holes are formed through both of the opposite side edges of the form and through the reinforcing strip. The holes in the reinforcing strip may be used to attach the license tag portion to an animal carcass with an attachment such as cord, wire, or the like. The reinforcing strip thus prevents the cord from tearing through the edge of the tag.

According to an aspect of the invention, the hunting license forms are preprinted only with basic, nonvariable information common to a plurality of types of licenses. The information specific to the type of license, date, licensed individual, etc., is printed on the license forms at the point of purchase. This allows a single license form to be used for several types of licenses.

According to an additional aspect of the invention, one or both of the major surfaces of the license form is marked or printed with an anticounterfeiting design. The anticounterfeiting design is preferably made in a color only slightly contrasting with the appearance of the surface on which it is carried. Such design deters counterfeiting or duplication of the form while not impairing the legibility of the information printed on the form.

In addition, the major surface of the license form to which the reinforcing strip is adhered is coated with a coloring material except in the marginal portion overlaid by the reinforcing strip. Since the MYLAR reinforcing strip is transparent, the major surface to which the reinforcing strip is applied has two regions of contrasting colors. This two color arrangement makes the license form more difficult to counterfeit. Also, various colors may be used to indicate the type of license and/or the time period for which the license is effective.

These and other objects, advantages, and features of the present invention will be more fully understood and appreciated by reference to the written specification and appended drawings.

DESCRIPTION OF THE PREFERRED EMBODIMENT

Figure 2:
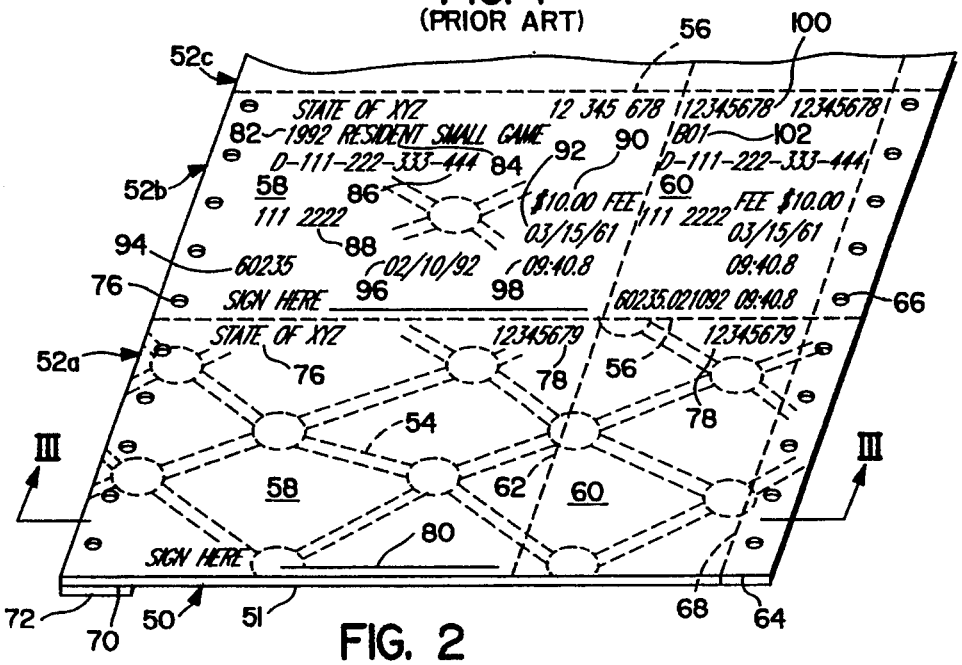
FIG. 2 is a fragmentary, front perspective view of a continuous web of hunting license forms according to the principles of the invention with thicknesses exaggerated.
Figure 3:
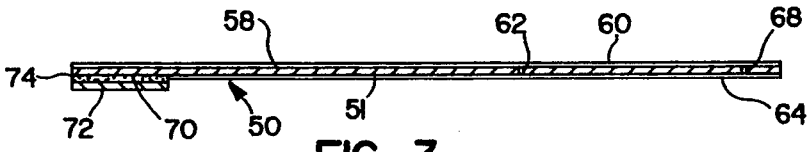
FIG. 3 is a sectional view taken along the line III—III of FIG. 2.
Figure 4:
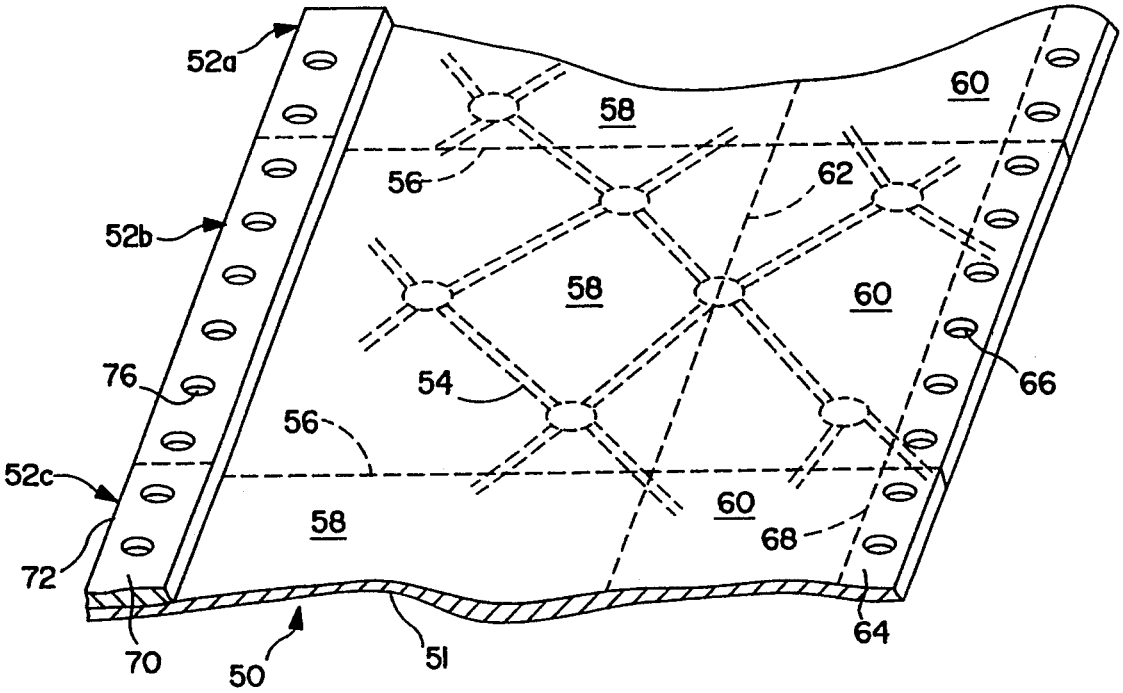
FIG. 4 is a fragmentary, rear perspective view of the continuous web of hunting license forms of FIG. 2.

By way of disclosing a preferred embodiment, and not by way of limitation, there is shown in FIGS. 2, 3 and 4 a longitudinally continuous web 50 of a base sheet 51 on which are formed a plurality of hunting license forms 52*a*, 52*b*, 52*c*, collectively referred to as license forms 52. License form 52*a* is shown with preprinted information and prior to printing at a point-of-sale terminal. License form 52*b* is shown with the additional variable information printed by the computerized printer associated with a point-of-sale terminal.

Figure 1:
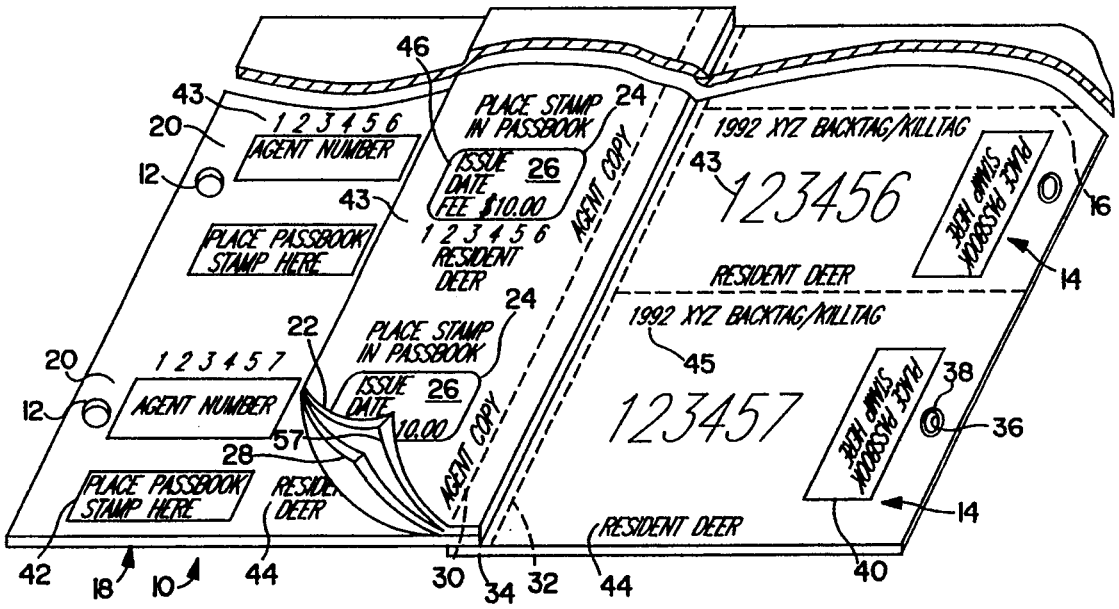
FIG. 1 (PRIOR ART)
FIG. 1 is a front perspective view of a page of hunting license forms according to the prior art with thicknesses exaggerated for clarity of illustration.

The front major surface of license form 52*a* is further shown marked with an anticounterfeiting design 54 in FIG. 1. For clarity of illustration, only a fragment of the anticounterfeiting design is shown on the front surface of the license form 52*b*. In FIG. 4, a fragment of the anticounterfeiting design 54 is shown extending over the rear major surfaces of the license forms 52. However, it should be understood that the anticounterfeiting design is preferably marked over the entirety of one or both of the major surfaces of the base sheet 51. The anticounterfeiting design is preprinted in a color which preferably only slightly contrasts with the surface of the base sheet 51 such as to make the license forms difficult to reproduce illegally.

Base sheet 51 is preferably formed of a tough, weather resistant, flexible, and printable material, preferably a synthetic fibrous material available under the trademark TYVEK. The continuous web 50 of license forms may be provided in fan folded or roll form.

The license forms 52 are joined together at their adjacent top and bottom edges by regularly spaced weakened lines 56 extending transversely across the web 50. The weakened lines are preferably formed by die cutting a perforated line.

Each license form 52 includes a rectangular license tag portion 58 and a rectangular record portion 60 in side-by-side relationship and joined at their adjacent side edges by a longitudinally extending weakened line 62 which is also preferably formed as a die cut perforated line.

Along the free edge of the record portions 60, opposite the license tag portions 58, there is a marginal strip 64 formed with a series of regularly spaced sprocket holes 66 provided for engagement with the pins of a pin feed tractor of a computerized printer. Marginal strip 64 is joined to the record portions along a weakened line 68 which also preferably perforated. Marginal strip 64 may be removed and discarded after the license forms are printed.

As best shown in FIGS. 3 and 4, along the free edge of the rear major surface of the license tag portions 58, opposite the record portions 60, there is a side marginal portion 70 overlaid with longitudinally continuous reinforcing strip 72 in registration with the side marginal portion. Reinforcing strip 72 is a tough, thin, flexible material, preferably a polyester film available under the trademark MYLAR. The reinforcing strip 72 is adhered to the marginal portion 70 by a layer of permanent adhesive 74 (FIG. 3).

A series of regularly spaced holes 76 are formed through the reinforcing strip and the marginal portion 70. Holes 76 perform two functions: First, holes 76 provided an engagement for the pins of a pin feed tractor of a computerized printer. Second, when the license tag portion is detached, a cord, wire, or the like, may be passed through one of the holes 76 and used to affix the license tag portion to an animal carcass. Since a metal grommet is not used, and the reinforcing strip is thin, the license form is suitable for being printed on a computerized printer without jamming.

As shown in FIG. 3, the rear major surface of the web is preferably coated with a colored coating material 110 except in the marginal portion overlaid by the reinforcing strip 72. The reinforcing strip is preferably of a transparent material, such as MYLAR, which allows the color of the base sheet 51 to be visible through the reinforcing strip. Thus, two regions of contrasting color are formed, one in registration with the reinforcing strip and a second disposed over the remainder of the base sheet exclusive of the region covered by the reinforcing strip. This arrangement makes the license form more difficult to counterfeit. Also, various color combinations may be used to correspond to the type of license and/or to the time period for which the license is effective. The front major surface of the base sheet 51 may also be coated with a colored coating material 112.

As shown in license form 52*a*, the license forms are preprinted with basic information, which may include the state of issuance 76, a stock or control number 78, and a signature line 80. The stock or control number 78 is also printed on the record portion 80.

At the point of purchase, additional, variable information is printed on the license forms by a computerized printer. As shown in license form 52*b*, the variable information may include the year 82, type of license 84, identification number 86, hunter safety certification number 88, fee amount 90, hunter birth date 92, agent number 94, purchase date 96, and purchase time 98. Much of this information may be repeated on the corresponding record portion, including the identification number, safety certification number, fee amount, birth date, agent number, and purchase date and time. The control number may be reprinted on the record portion as at 100. A license code 102 may also be printed on the record portion.

In use, the selling agent enters the necessary data at a computerized point-of-sale terminal. The continuous web 50 of license forms is fed through a computerized printer and the license forms being purchased are imprinted with the appropriate variable information. The agent retains the printed record portions 60. The hunter is given the group of printed license tag portions 58. The purchase data may be transmitted electronically from the point-of-sale terminal to a central governmental authority. The printed record portions may be kept or discarded after the data has been centrally collected and verified.

While hunting, the hunter detaches a license tag portion from the group and displays it visibly on his back or as required by local law. When an animal is killed, the hunter affixes the tag to the animal carcass by means of a cord or the like passing through one of the holes 76 formed in the marginal portion 70 of the license tag portion.

The rear surface of the license forms, shown in FIG. 4, may be preprinted with additional material, such as instructional information to the hunter and markings defining notch-out areas by which the hunter may indicate the date of kill, animal sex, and number of antler points.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A hunting license form comprising:

a flexible base sheet having first and second opposed major surfaces, a license tag portion, and a record portion;

said license tag portion having spaced apart, opposed top and bottom edges, and spaced apart, opposed first and second side edges;

said record portion having spaced apart, opposed top and bottom edges, and spaced apart, opposed first and second side edges;

said first side edge of said license tag portion being temporarily and separably joined to said first side edge of said record portion along a weakened line formed in said base sheet;

said license tag portion further having a longitudinally extending marginal edge portion formed along said second side edge of said license tag portion, said marginal edge portion having a series of longitudinally, regularly spaced holes formed therethrough for engagement with a pin feed tractor of a printer and for attachment of said license tag portion to an animal carcass, said marginal strip being nonremovable;

said record tag portion further having a longitudinally extending marginal strip along said second side edge of said record portion, said marginal strip having a series of longitudinally, regularly spaced holes formed therethrough for engagement with a pin feed tractor of a printer, said hunting license form further including a weakened line formed between said second side edge of said record portion and said marginal strip, whereby said marginal strip formed along said record portion is removable.

2. The hunting license form of claim 1 further comprising a strip of thin, flexible reinforcing material overlying and adhered to a portion of one of said major surfaces in registration with said marginal edge portion of said license tag portion.

3. The hunting license form of claim 2 wherein said reinforcing material comprises a polyester film.

4. The hunting license form of claim 1 wherein a plurality of said hunting license forms are provided on a continuous web of said base sheet and separably joined along adjacent top and bottom edges of said hunting license forms.

5. A continuous web of a plurality of hunting license forms comprising:

a flexible, longitudinally continuous base sheet web having transversely spaced apart first and second side edges and first and second opposed major surfaces;

a plurality of said hunting license forms formed in adjacency along the length of said base sheet, each of said hunting license forms having longitudinally spaced apart, transversely extending top and bottom edges, with the top edge of one hunting license form being separably joined to the bottom edge of an adjacent hunting license form along a weakened line;

each of said hunting license forms comprising a rectangular license tag portion having transversely spaced apart first and second side edges, and a rectangular record portion having transversely spaced apart first and second side edges, with the first side edge of said license tag portion being separably joined to the first side edge of said record portion along a weakened line, said second side edge of each license tag portion being coextensive with said first side edge of said continuous web;

a longitudinally continuous strip of reinforcing material overlyingly adhered to a nonremovable marginal edge portion of one of said major surfaces of said base sheet web extending along said first side edge of said base sheet web;

a first series of longitudinally regularly spaced holes formed through said strip of reinforcing material and said marginal edge portion of said base sheet web for engagement with the pin feed tractor of a printer and for the passage of a means for attaching a said license tag portion to an animal carcass; and a second series of longitudinally regularly spaced holes formed through said base sheet web adjacent said second side edge of said base sheet web for engagement with the pin feed tractor of a printer.

6. The continuous web of a plurality of hunting license forms of claim 5 wherein said reinforcing material comprises a transparent polyester film.

7. The continuous web of a plurality of hunting license forms of claim 5 further comprising a longitudinal weakened line formed between said second side edge of said record portion and said second series of longitudinally regularly spaced holes, wherein said second series of longitudinally spaced holes are removable from said forms, said first series of longitudinally spaced holes being unremovable from said forms.

8. The continuous web of a plurality of hunting license forms of claim 5 wherein said base sheet web is a tough, synthetic fiber material.

9. Hunting license forms comprising:

a longitudinally extending, flexible base sheet web having first and second spaced apart side edges and first and second opposed major surfaces;

a strip of tough, flexible reinforcing material overlyingly adhered to a marginal edge portion of one of said major surfaces of said base sheet web along said first side edge of said base sheet web;

a first series of longitudinally regularly spaced holes formed through said strip of reinforcing material and said marginal edge portion for engagement with a pin feed tractor of a printer and for the passage of a means for attachment to an animal carcass;

a second series of longitudinally regularly spaced holes formed through said base sheet web adjacent said second side edge of said base sheet web;

a first weakened line formed longitudinally in said base sheet web disposed between said first series of longitudinally regularly spaced holes and said second series of longitudinally regularly spaced holes;

a plurality of longitudinally regularly spaced second weakened lines formed transversely across said base sheet web;

a plurality of rectangular license tag portions each having a top edge defined by one of said second weakened lines, a bottom edge defined by an adjacent one of said second weakened lines, a first side edge coinciding with said first side edge of said base sheet web, and a second side edge defined by said first weakened line; and a plurality of rectangular record portions in correspondence with said license tag portions, each of said record portions having a top edge defined by said one of said second weakened lines, a bottom edge defined by said adjacent one of said second weakened lines, and a first side edge defined by said first weakened line.

10. Hunting license forms comprising:

a longitudinally extending, flexible base sheet web having first and second spaced apart side edges and first and second opposed major surfaces;

a strip of tough, flexible reinforcing material overlyingly adhered to a marginal edge portion of one of said major surfaces of said base sheet web along said first side edge of said base sheet web;

a first series of longitudinally regularly spaced holes formed through said strip of reinforcing material and said marginal edge portion for engagement with a pin feed tractor of a printer and for the passage of a means for attachment to an animal carcass;

a second series of longitudinally regularly spaced holes formed through said base sheet web adjacent said second side edge of said base sheet web;

a first weakened line formed longitudinally in said base sheet web disposed between said first series of longitudinally regularly spaced holes and said second series of longitudinally regularly spaced holes;

a plurality of longitudinally regularly spaced second weakened lines formed transversely across said base sheet web;

a plurality of rectangular license tag portions each having a top edge defined by one of said second weakened lines, a bottom edge defined by an adjacent one of said second weakened lines, a first side edge coinciding with said first said edge of said base sheet web, and a second side edge defined weakened line;

a plurality of rectangular record portions in correspondence with said license tag portions, each of said record portions having a top edge defined by said one of said second weakened lines, a bottom edge defined by said adjacent one of said second weakened lines, and a first side edge defined by said first weakened line; and a third weakened line formed in said base sheet extending longitudinally and disposed between said second series of longitudinally regularly spaced holes and said first weakened line, said license tag portions each having a second side edge defined by said third weakened line, wherein said second series of longitudinally spaced holes are removable from said forms, said first series of longitudinally spaced holes being unremovable from said forms.

11. The hunting license forms of claim 9 wherein said base sheet is a synthetic, fibrous material and said reinforcing strip is a polyester film.

12. A hunting license form comprising:

a flexible base sheet having first and second opposed major surfaces, a license tag portion, and a record portion;

said license tag portion having spaced apart, opposed top and bottom edges, and spaced apart, opposed first and second side edges;

said record portion having spaced apart, opposed top and bottom edges, and spaced apart, opposed first and second side edges;

said first side edge of said license tag portion being temporarily and separably joined to said first side edge of said record portion along a weakened line formed in said base sheet;

said license tag portion further having a longitudinally extending marginal edge portion formed along said second side edge of said license tag portion, said marginal edge portion having a series of longitudinally, regularly spaced holes formed therethrough for engagement with a pin feed tractor of a printer and for attachment of said license tag portion to an animal carcass, said marginal strip being nonremovable; and said hunting license further including a strip of thin, flexible reinforcing material overlying and adhered to a portion of one of said major surfaces in registration with said marginal edge portion of said license tag portion.

* * * * *

UNITED STATES PATENT AND TRADEMARK OFFICE

CERTIFICATE OF CORRECTION

PATENT NO. : 5,351,993

DATED : October 4, 1994

INVENTOR(S) : Wright et al

It is certified that error appears in the above-indentified patent and that said Letters Patent is hereby corrected as shown below:

In the Abstract, Line 12:
after "preprinted" insert --with--

Column 8, Claim 10, Line 29:
after "defined" insert --by said first--

Signed and Sealed this

Thirteenth Day of December, 1994

Bruce Lehman

*Attest:*

BRUCE LEHMAN

*Attesting Officer*

*Commissioner of Patents and Trademarks*